US007526902B2

(12) United States Patent
Green et al.

(10) Patent No.: US 7,526,902 B2
(45) Date of Patent: May 5, 2009

(54) FRAMING SYSTEM FOR MOUNTING FLEXIBLE SHEETS

(75) Inventors: Guerry E. Green, Pawleys Island, SC (US); Robert T. Hokum, Jr., Mt. Pleasant, SC (US)

(73) Assignee: Marhaygue, LLC, Pawleys Island, SC (US)

( * ) Notice: Subject to any disclaimer, the term of this patent is extended or adjusted under 35 U.S.C. 154(b) by 0 days.

(21) Appl. No.: 11/945,756

(22) Filed: Nov. 27, 2007

(65) Prior Publication Data

US 2008/0289278 A1 Nov. 27, 2008

Related U.S. Application Data

(63) Continuation of application No. 11/105,987, filed on Apr. 14, 2005, now abandoned.

(60) Provisional application No. 60/563,360, filed on Apr. 19, 2004.

(51) Int. Cl.
*E06B 3/00* (2006.01)
*E04C 2/38* (2006.01)
*E04B 1/00* (2006.01)

(52) U.S. Cl. ..... 52/656.9; 52/204.5; 52/222

(58) Field of Classification Search ..... 52/214, 52/204.5, 204.53, 204.54, 204.55, 204.56, 52/222, 410, 656.1, 656.2, 656.5, 656.7, 52/656.9

See application file for complete search history.

(56) References Cited

U.S. PATENT DOCUMENTS 2,526,912 A * 10/1950 Swanson ..... 160/90
2,886,481 A * 5/1959 Swan ..... 156/88
3,058,518 A * 10/1962 Housman ..... 160/380
4,164,105 A * 8/1979 Herbst et al. ..... 52/202
4,170,810 A * 10/1979 Peleg ..... 24/462
4,586,301 A * 5/1986 Hickman ..... 52/96
4,676,024 A * 6/1987 Rossman ..... 49/62
5,076,033 A * 12/1991 Patsy, Jr. ..... 52/222
5,097,886 A * 3/1992 Moyet-Ortiz ..... 160/368.1
5,657,579 A * 8/1997 Bruchu et al. ..... 49/161
5,702,147 A * 12/1997 Essig ..... 296/106
5,906,078 A * 5/1999 Cramer ..... 52/222
5,983,467 A * 11/1999 Duffy ..... 24/442
6,314,684 B1 * 11/2001 Aviram ..... 52/11
6,378,267 B1 * 4/2002 Bass ..... 52/656.7

(Continued)

*Primary Examiner*—Richard E Chilcot, Jr.
*Assistant Examiner*—Mark R Wendell
(74) *Attorney, Agent, or Firm*—Sara Centioni Kanos; Nexsen Pruet, LLC

(57) ABSTRACT

A framing system for mounting flexible sheets of material, such as screening in an opening in a wall or porch includes U-shaped channels, or lineals, having at least one external built-in groove for receiving a spline strip for holding an edge of the sheet in place in the groove. Four lineals define a rectangular opening over which the sheet is stretched and then secured in place by jamming its edges into the external spline grooves of the surrounding four lineals with the spline strips to hold the sheet in place. Universal fasteners hold the lineals to the porch walls. The universal fasteners also have alignment grooves on their upper surface, lower surface or both of these surfaces that are useful for receiving an alignment string or wire to align a series of the fasteners across a surface so that they are in line to receive and accurately align a single lineal or multiple lineals arranged end to end.

20 Claims, 5 Drawing Sheets

U.S. PATENT DOCUMENTS 6,510,661 B2 * 1/2003 Gorman ..... 52/204.51
6,668,495 B1 * 12/2003 Prince ..... 52/63
6,964,290 B2 * 11/2005 Woodward et al. ..... 160/92
2004/0168383 A1 * 9/2004 Reynolds et al. ..... 52/273

* cited by examiner

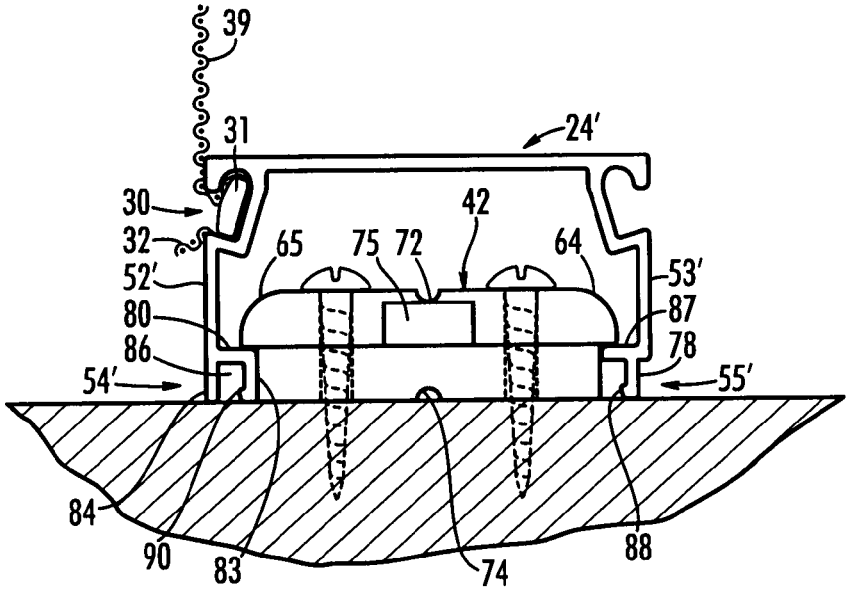
FIG. 9
FIG. 10
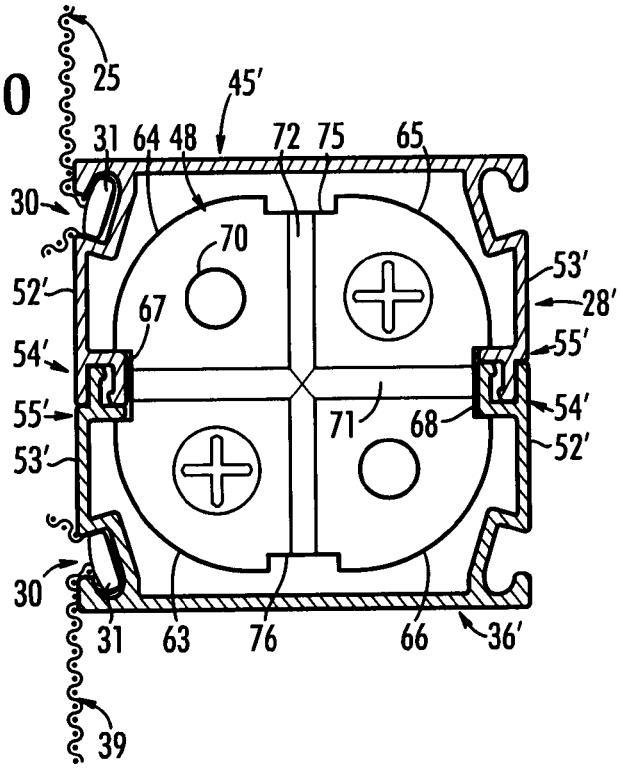

FRAMING SYSTEM FOR MOUNTING FLEXIBLE SHEETS

PRIORITY CLAIM

The present application is a continuation in part of US non-provisional application Ser. No. 11/105,987, filed Apr. 14, 2005, now abandoned which claims the priority benefit of US provisional application Ser. No. 60/563,360 filed Apr. 19, 2004.

FIELD OF INVENTION

The present invention relates generally to building materials, and more specifically to framing for mounting flexible sheet materials such as screening.

BACKGROUND OF INVENTION

Prior art framing systems for mounting screening on porches and in openings, such as windows, often require the installation of heavy and cumbersome frame members that are difficult to place and then hold in an aligned position while they are being securely attached to a support structure. Once installed, these conventional frame members are often subject to relatively rapid deterioration and are difficult to repair and/or replace.

SUMMARY OF INVENTION

The present invention provides a framing system for mounting flexible sheets of material, such as metal or plastic screening. It is intended for use in preparing an opening in a wall or on a covered porch or patio to receive screening or other flexible sheets, such as nonporous plastic sheets for winterizing. As framing members, called lineals, it utilizes light U-shaped channels made of flexible metal, plastic, or pulltruded fiberglass and having at least one external built-in groove for receiving a spline strip for holding an edge of the sheet in place in the groove. Thus, four lineals define a rectangular opening over which the sheet is stretched and then secured in place by jamming its edges into the external spline grooves of the surrounding lineals with one or more of the spline strips. A significant feature of the system is that the lineals become the only exposed feature of the installed. There are no exposed fasteners. Beside the screws that hold the universal fasteners to the building, the system consists of only the lineals and the universal fasteners; the system forms a strong, trim support for holding screening in place and possibly for, with appropriate fixtures, for holding transparent sheeting for enclosing the porch or patio.

Each lineal from the exterior appears as an elongated half box with a spline groove along one or both sides, and has a generally U-shaped cross section. The lineals are preferably made of extruded plastic in white or desired color, pulltruded fiberglass that has been painted a desired color, or aluminum that has been painted or powder coated in a desired color. Individual lineals may be secured to the surface of a structural support member using a "universal fastener" of the invention as an internal interlocking anchor. The lineals are generally symmetrical and two of these may be oriented opposite to each other and joined together securely to form a hollow mullion without the use of any tools or any screws or bolts. The two joined lineals may be secured together using the "universal fastener" of the invention as an internal interlocking "clip" between the two. Alternatively, the opposing lineals may be joined together by an interlocking structure formed by a tongue along the distal edge of one arm and a groove along the distal edge of the other arm of each lineal, or by both the clip and the arm interlocking structures.

An especially important feature is that the lineals may be secured to a surface in two different ways by the fasteners, each of which is preferably symmetrical around a central axis and has both an anchor orientation and a clip orientation. First, an individual lineal can be slid or snapped over an anchor oriented fastener so that the longitudinal axis of the lineal is substantially perpendicular to the central axis of the fastener and parallel to the surface to which the fastener is attached. Second, two opposing lineals may be joined together to form a horizontal or vertical mullion, which is a rectangular hollow beam or post, that will slide or snap over a clip oriented fastener so that the longitudinal axis of the mullion is substantially coaxial with the central axis of the fastener and perpendicular to the surface to which the fastener is attached.

The mullions comprising two joined lineals may serve as frame members to create some or all of the openings over which the flexible material is to be secured. On the other hand, individual lineals may be secured to the surfaces of conventional wood framing around an opening using the fasteners in their anchor orientation. Thus, a large opening defined by conventional corner posts extending between a floor and a ceiling, such as on a porch or covered patio, may have individual lineals secured to the conventional surfaces around the opening using the fasteners in their anchor orientation, and then smaller openings may be framed within the larger opening using vertically and horizontally positioned mullions mounted with fasteners in their clip orientation.

The universal fasteners are preferably made of a hard, strong molded plastic. They may be attached to the surfaces of walls, floors, studs or other conventional building components, or to the surfaces of previously installed lineals of the invention, preferably using screws. Holes are preformed or drilled in the fasteners for at least two and up to four screws. The universal fasteners also have alignment grooves on their upper surface, lower surface or both of these surfaces that are useful for receiving an alignment string or wire to align a series of the fasteners across a surface so that they are in line to receive and accurately align a single lineal or multiple lineals arranged end to end or a plurality of mullions.

As is evident from the foregoing summary and the detailed description below, a large opening on a porch or patio or through a wall can have smaller openings framed therein and covered with sheets of flexible material in any desired pattern using the universal fastener and lineal system of the invention. Fasteners in their anchor orientation are first placed on conventional surfaces all around the larger opening using sight alignment and/or a carpenters string and are attached to those surfaces by being screwed securely into place. Then, individual lineals are snapped over the anchor fasteners with their long dimensions parallel to the surface to which these fasteners are attached. Additional fasteners are thereafter fastened to the surfaces of the anchored lineals where mullions are to be placed, these additional fasteners having a clip orientation relative to the mullions that they will secure. Two oppositely facing individual lineals of the requisite length are then positioned between two opposing clip fasteners with their long dimensions perpendicular to the two surfaces to which the clip fasteners are attached, and the respective U-shaped ends of the lineals are snapped over the clip fasteners, and preferably are also snapped together, to form a corresponding mullion.

Horizontal and vertical mullions can be assembled in this way to divide the space of the large opening into a plurality of smaller openings arranged in any manner desired. Next, a sheet of screen or other flexible material is placed over each framed opening so as to extend beyond the surrounding spline grooves, and then spline strips are placed over edge portions of the flexible material and pushed into the spline grooves along with the edge portions so that the material is stretched between and secured to the surrounding lineals. The excess flexible material beyond the grooves is then trimmed away. The lineals and mullions of the invention are highly resistant to deterioration and, if damaged, these frame members are relatively easy to repair and/or replace by prying them away from their fasteners in a manner that is the reverse of the snap actions by which they are attached to the fasteners.

BRIEF DESCRIPTION OF THE DRAWINGS

The invention and its components, structure and assembly may be further understood by reference to the detailed description below taken in conjunction with the accompanying drawings in which:

FIG. 9 is an end view of a modified lineal formed and installed in accordance with another embodiment of the framing system of the invention; and, FIG. 10 is an end view of a modified mullion formed and installed in accordance with the framing system embodiment of FIG. 9.

DETAILED DESCRIPTION OF PREFERRED EMBODIMENTS

Figure 1:
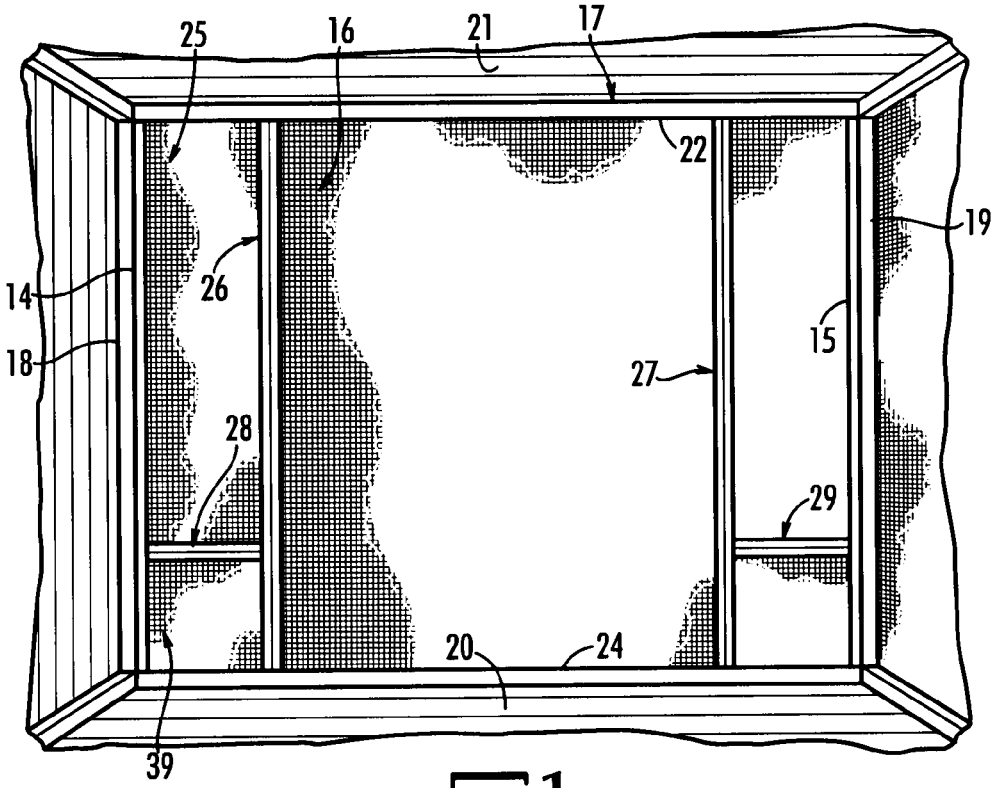
FIG. 1 is an elevational view of a porch opening that has been covered with flexible screening in accordance with the framing system of the invention.
Figure 2:
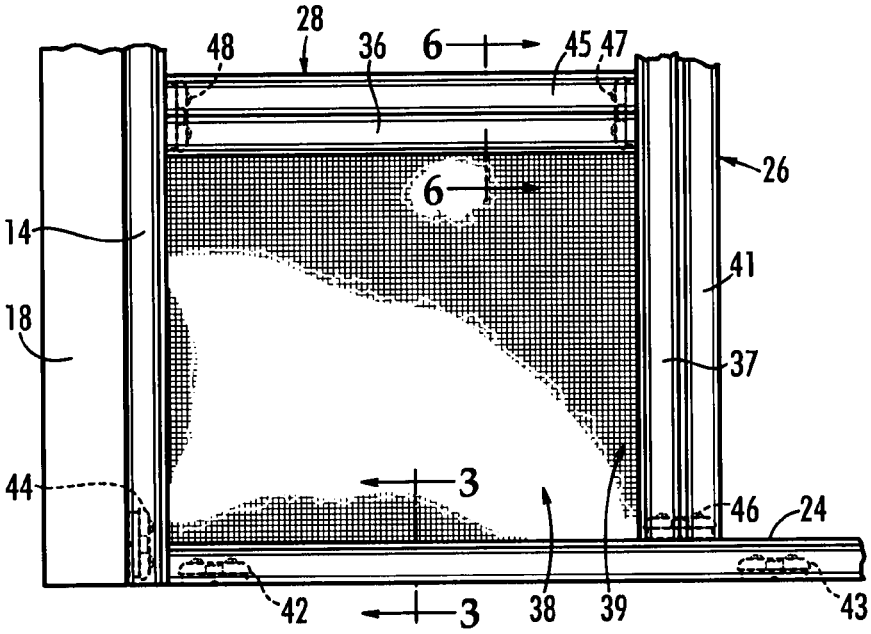
FIG. 2 is a fragmentary view of a portion of the framing of FIG. 1.

FIGS. 1 and 2 of the drawings show a framing system, generally designated 14, for mounting flexible sheets of material, such as metal or plastic screening 16, within an opening 17 that may be define by conventional framing materials or by mullions made in accordance with the invention. For example, the opening 17 to receive the screening 16 or some other flexible sheets, such as nonporous plastic sheets for winterizing, may be formed by the corner posts 18 and 19, the floor 20 and the ceiling 21 of a porch. For purposes of this disclosure, the framing members of the invention comprise light U-shaped channels called lineals, such as the lineals 14, 15, 22 and 24, and hollow box-like elongated members called mullions, such as posts 26 and 27 and beams 28 and 29, each of which is assembled from a pair of the lineals.

Figure 3:
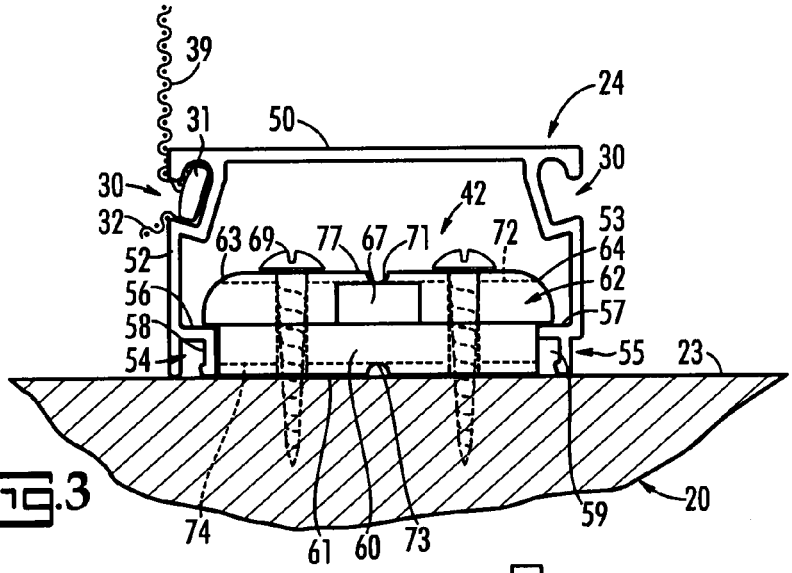
FIG. 3 is a sectional view taken along line 3-3 of FIG. 2 and shows a lineal formed and installed in accordance with the framing system of the invention.

Referring now to FIG. 3, each lineal, such as lineal 24, has at least one external built-in spline groove 30 for receiving a spline strip 31 for holding an edge portion 32 of the screen sheet 39 in place in the groove. Thus, the four lineals 24, 14, 36 and 37 define a rectangular opening 38 over which the screen sheet 39 is stretched and then secured in place by jamming its edges into the external spline grooves of these surrounding lineals with one or more of the spline strips 31 as illustrated in FIGS. 2 and 3. These lineals are preferably identical so that only lineal 24 will be described below in detail. From the exterior, lineal 24 appears as an elongated half box with a spline groove 30 along one or both sides, and has a generally U-shaped cross section. The lineals are preferably made of extruded plastic in white or desired color, pulltruded fiberglass that has been painted a desired color, or extruded aluminum that has been painted or powder coated in a desired color.

An especially important feature of the invention is that the lineals may be secured to a surface in two different ways by a special "universal fastener", which has both an anchor orientation as illustrated by the fasteners 42, 43 and 44 and a clip orientation as illustrated by the fasteners 46, 47 and 48 shown in FIG. 2. In assembling the framing system 14, the individual lineals 24 and 14 are slid or snapped over their respective anchor oriented fasteners 42, 43, and 44 so that the longitudinal axis of the lineal is substantially perpendicular to the central axis of the fastener and parallel to the surface to which the fastener is attached by screws, bolts or the like.

Lineals having the cross-sectional form of lineal 24 are entirely symmetrical and two of these may be oriented opposite to each other and joined together by a fastener to form a hollow mullion as described below without the use of any tools or any screws or bolts. Thus, the clip oriented fastener 46 is attached by screws, bolts or the like to lineal 24, and then used with another clip oriented fastener (not shown) attached to lineal 22 for joining together two opposing lineals 37 and 41 to form the vertical mullion or post 26, which is a generally rectangular hollow frame member having a longitudinal axis that is substantially coaxial with a central axis of the fastener 46 and perpendicular to the upper surface of lineal 24 to which this fastener is attached.

The clip oriented fastener 47 is then similarly attached to lineal 37 and used with clip oriented fastener 48, which is similarly attached to lineal 14, for joining together the two opposing lineals 36 and 45 to form the horizontal mullion or beam 28, which is a generally rectangular hollow frame member having a longitudinal axis that is substantially coaxial with central axes of the fasteners 47 and 48 and perpendicular to the upper surface of the lineals to which these fasteners are attached. Next the sheet 39 of screen or other flexible material is placed over the framed opening 38 so as to extend beyond the respective spline grooves 30 adjacent to the opening 38, and spline strips 31 are placed over the flexible material edges 32 and then inserted into the spline grooves 30 so that the material is stretched between and secured to the surrounding lineals 14, 36, 37 and 24. Any excess flexible material beyond the grooves 30 is then trimmed away.

Figure 6:
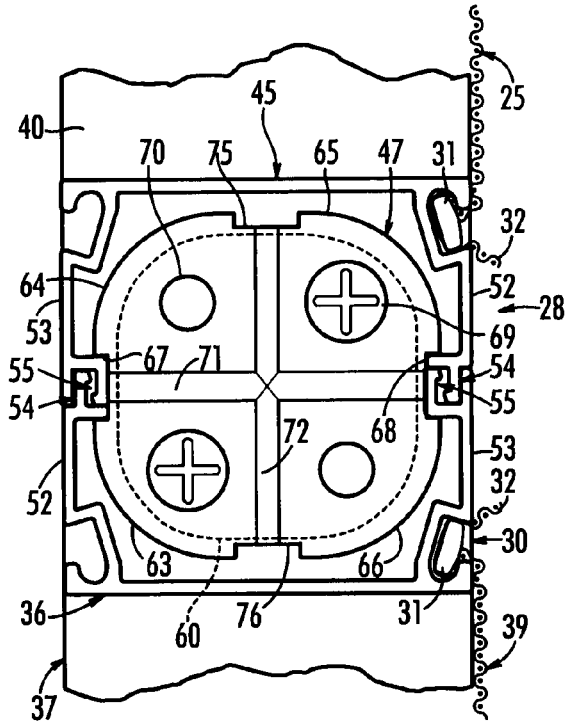
FIG. 6 is a sectional view taken along line 6-6 of FIG. 2 and shows a mullion formed and installed in accordance the framing system of the invention.

Referring again to FIG. 3, each of the lineals, for example lineal 24, has a base 50 and opposing resilient arms 52 and 53 with respective distal edge portions 54 and 55 having corresponding inwardly projecting ledges 56 and 57 and depending L-shaped stops 58 and 59, respectively. The inner edges of these ledges define a transverse space for receiving one or more of the universal fasteners, for example the fastener 42. The fastener 42 includes a central column 60 having a base surface 61 at one end and a radially projecting rim forming a crown 62 at the opposite end that is separated into four arcuate bosses 63, 64, 65 and 66 by two pairs of opposing notches 67, 68 and 75, 76 (FIG. 6). Although only one pair of these notches is needed for the clip orientation, two pairs are preferred so that the fasteners are symmetrical and present the same functional features upon every 90 degrees of rotation about the central axis of column 60, which facilitates quick and accurate positioning thereof in both the clip and anchor orientations.

Figure 4A:
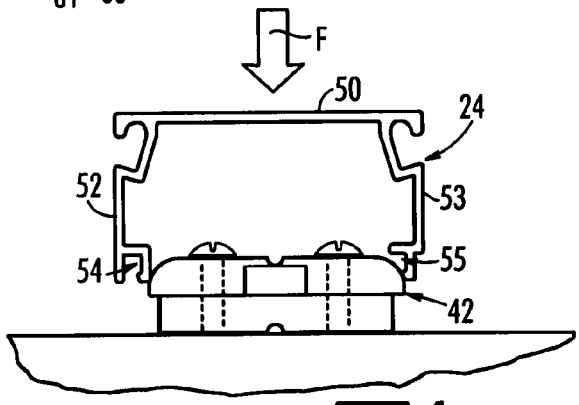
FIGS. 4A, 4B and 4C are end views of the lineal of FIG. 3 illustrating the snap action by which the lineal may be attached to the fastener of the invention.
Figure 4B:
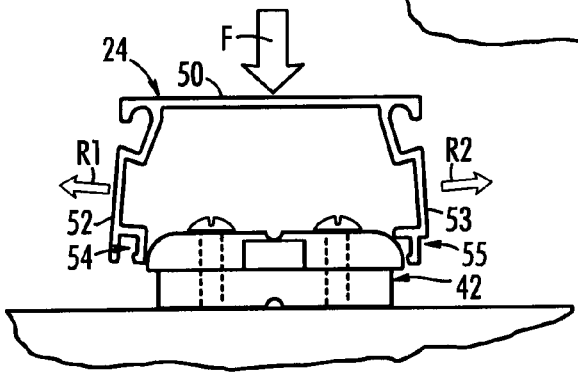
Figure 4C:
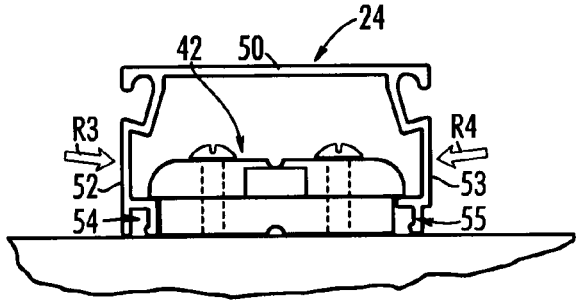

Portions of the bosses immediately adjacent to one notch extend away from portions of the bosses adjacent to the opposing notch on the opposite side of column 60 to provide a lateral crown dimension between opposite distal crown edges that is greater than the transverse space between the channel ledges such that the ledge 56 may be snapped over and interlocked with bosses 64,65 on one column side and ledge 57 may be snapped over and interlocked with bosses 63,66 on the opposite column side as shown in FIG. 3. This attachment action is further illustrated in FIGS. 4A-4C, which show that a force F applied to the base 50 of lineal 24 at first causes laterally outward flexure of resilient legs 52 and 53 in the direction of arrows R1 and R2, follow by laterally inward snapping of resilient legs 52 and 53 in the direction of arrows R3 and R4.

Figure 5:
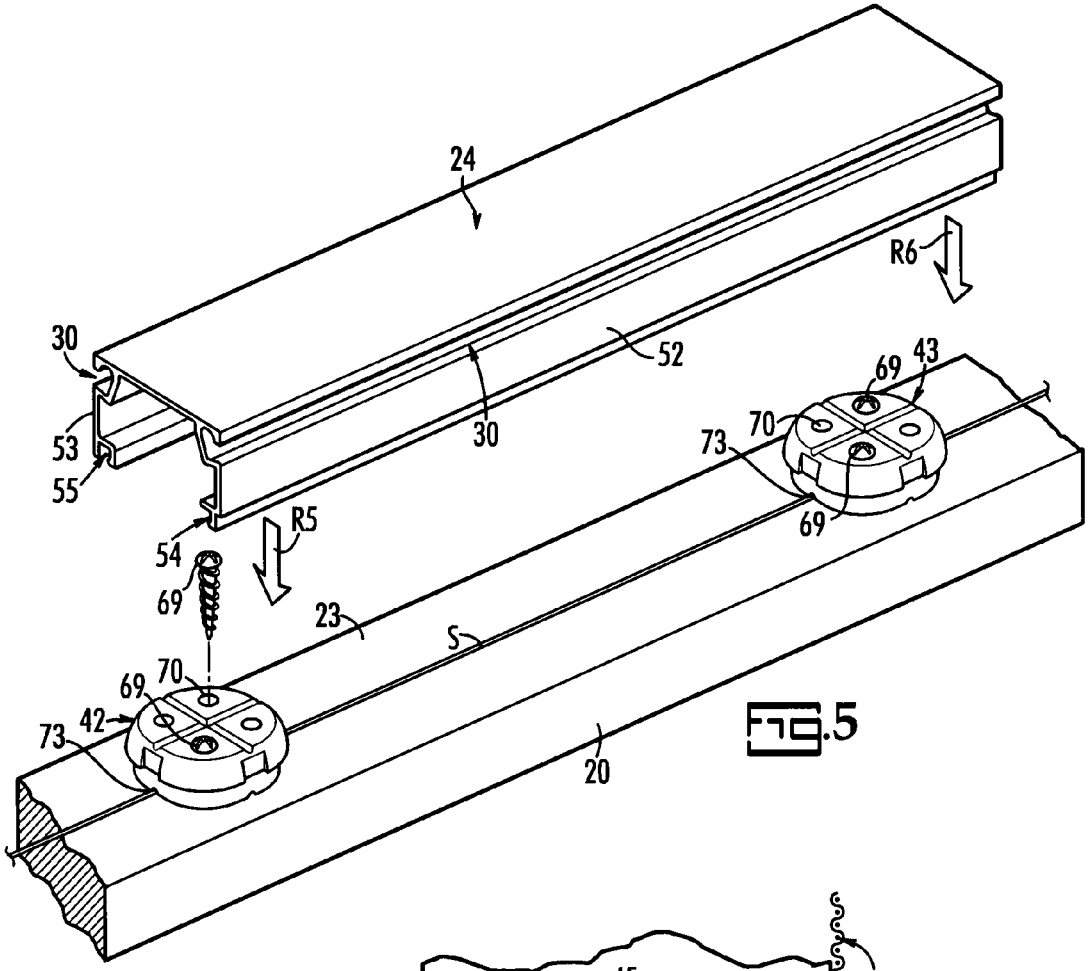
FIG. 5 is a perspective view illustrating how a series of the fasteners may be properly aligned for receiving the lineal of FIG. 3.

Prior to its attachment to fasteners 42 and 43, lineal 24 is first aligned with these fasteners and then moved laterally toward them as indicated by arrows R5 and R6 in FIG. 5. Upon being snapped thereover, lineal 24 is thereby securely attached to the fasteners 42 and 43 for preventing lineal movement parallel to the central axis of fastener column 60, i.e., away from the underlying support surface 23 of floor 20. Means for securing the base surface 61 of column 60 to a conventional building structure, such as porch flooring 20, ceiling 21 and corner posts 18 and 19, may be provided by two or more screws 69,69 passing through corresponding holes 70 in the body of fastener 42. Preferably, four holes are provided in the body of the fastener, and they extend parallel to and are positioned symmetrically about the central axis of its column.

Prior to the foregoing securing step, multiple fasteners for receiving a single lineal or mullion are preferably arranged in proper alignment using an aligning wire or string S that may be fitted in corresponding grooves across either the upper surface of the crown 62 or across the surface 61 at the base of column 60 as illustrated in FIG. 5. Properly aligned fasteners also insures the proper alignment of multiple lineals secured in line to the same surface, and of multiple mullions secured in spaced relation between the same opposing surfaces. Where the fasteners are symmetrical, as is preferred, the outer crown surface 77 has two grooves 71 and 72 perpendicular to each other and the base surface 61 has two grooves 73 and 74 perpendicular to each other, each of these grooves being capable of receiving the aligning wire or string S.

As previously mentioned, the crown 62 is interrupted by two pairs of opposing notches 67, 68 and 75, 76, one notch of each pair being on opposite sides of the column 60 between opposing ends of the arcuate bosses 63, 64, 65 and 66. The bottoms of opposing notches are spaced apart by a lateral crown dimension that is less than the transverse space between the channel ledges 56 and 57 such that these channel ledges of two oppositely facing lineals may be snapped over arcuate runs of the bosses and interlocked with opposing notches as shown in FIG. 6.

Figure 7A:
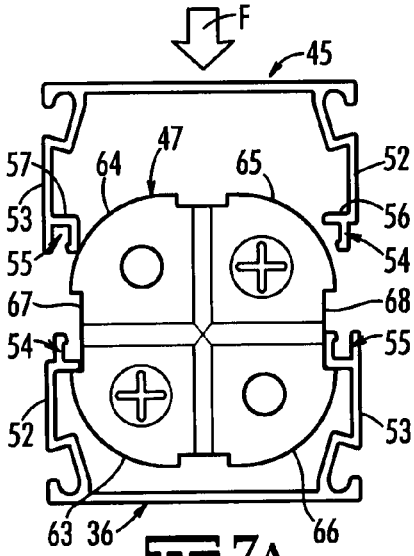
FIGS. 7A, 7B and 7C are end views of the mullion of FIG. 6 illustrating the snap action by which the mullion may be attached to the fastener of the invention.
Figure 7B:
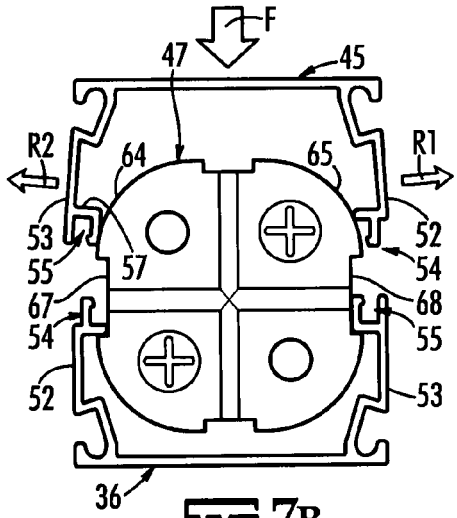
Figure 7C:
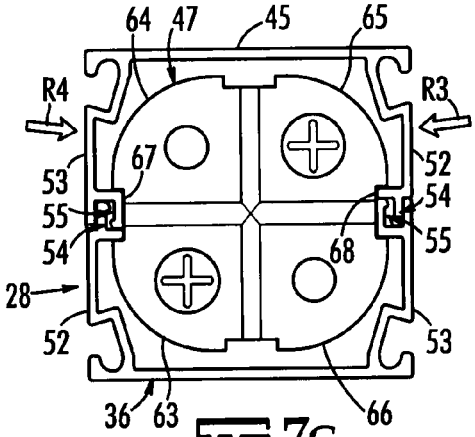

This attachment action is further illustrated in FIGS. 7A-7C, which show that a force F applied to the base 50 of lineal 45 at first causes laterally outward flexure of resilient legs 52 and 53 in the direction of arrows R1 and R2, follow by laterally inward snapping of resilient legs 52 and 53 in the direction of arrows R3 and R4, such that the ledge 56 may be snapped over an arcuate run of boss 65 and interlocked with notch 68 on one column side and ledge 57 may be snapped over an arcuate run of boss 64 and interlocked with notch 67 on the opposite column side to attach lineal 45 to fastener 47 as shown in FIGS. 7A and 7C. Lineal 45 is simultaneously attached to fastener 48 in the same way as described above for its attachment to fastener 47, these two fasteners being mounted in opposing relation on opposing surfaces 40 and 49 of lineals 14 and 37, respectively.

Figure 8:
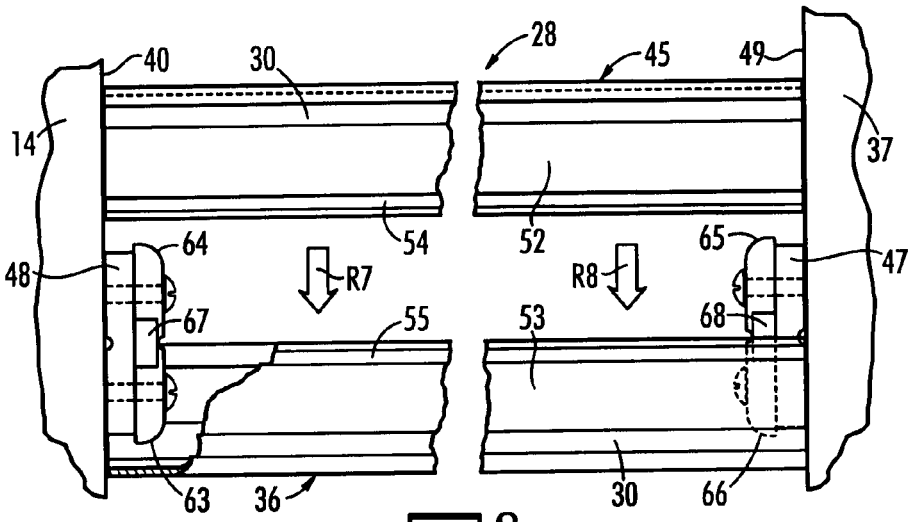
FIG. 8 is a side elevational view illustrating how a pair of lineals may be clipped together by and installed between two opposing fasteners to form a mullion of the invention.

Prior to its attachment to fasteners 47 and 48, lineal 45 is first aligned with these opposing fasteners and then moved laterally toward them as indicated by arrows R7 and R8 in FIG. 8. Upon being snapped thereover, lineal 45 is thereby securely attached to the fasteners 47 and 48 for preventing lineal movement perpendicular to the central axis of fastener column 60, i.e., parallel to the supporting surface of lineal 37. Lineal 36 was previously attached to fasteners 47 and 48 in the same way except for being snapped on from the opposite direction, such that the above attachment of lineal 45 forms mullion 28, by securing together a pair of opposing lineals, such as lineals 36 and 45, with two of the fasteners, such as fasteners 47 and 48 as shown in FIGS. 2 and 8.

Since the fasteners 47 and 48 are attached by screws or the like to respective opposing surfaces 49 and 40 of anchored lineals 37 and 14, these fasteners prevent parallel movement of the mullion 28 relative to its supporting surfaces, i.e., perpendicular movement of the mullion 28 relative to the central axis of the columns 60 of fasteners 47 and 48. The opposing surfaces of anchored lineals 14 and 37 prevent parallel movement of the mullion 28 relative to the central axis of the columns 60. After mullion 28 has been securely mounted in this manner, the edge of screen sheet 25 is attached to the mullion by being pushed into the groove 30 of lineal 45 by spline strip 31, and the edge of screen sheet 39 is attached to the mullion by being pushed into the groove 30 of lineal 36 by another spline strip 31 as shown in FIG. 6.

Mullions 26, 27 and 29 each comprise two opposing lineals joined in the same manner as mullion 28. Thus, one or more such mullions may serve as frame members to create a pattern of openings over which sheets of flexible material are secured as illustrated in FIG. 2. On the other hand, individual lineals 14, 15, 22 and 34 may be secured to the surfaces of conventional wood framing, such as posts 18 and 19, floor 20 and ceiling 21, using fasteners in their anchor orientation to prepare the larger opening 17 for receiving these mullions. Thus, a large opening defined by conventional posts, studs, beams or other framing members may have individual lineals secured to the conventional surfaces around this opening using the fasteners in their anchor orientation, and then any desired pattern of smaller openings may be framed within the large opening using vertically and horizontally positioned mullions mounted with the fasteners in their clip orientation.

Referring now to FIGS. 9 and 10, there are shown respectively a modified lineal 24' and a modified mullion 28' that differ from the lineal 24 and the mullion 28 described above in the structures of the distal edge portions 54' and 55' of the lineal arms 52' and 53', respectively. Edge portion 55' has a tongue 78 extending along the length of the arm 53' below its corresponding ledge 87, and edge portion 54' has a pair of opposing walls 83 and 84 forming a snap groove 86 extending along the length of arm 52' below its corresponding ledge 80. The tongue 78 has a lip 88 and the wall 83 of groove 86 has a lip 90 such that, when two identical lineals 36' and 45' are positioned opposite to each other with the arms of one opposing the arms of the other as shown in FIG. 10, the tongue 78 of lineal 45' may be snapped into the groove 86 of the opposing lineal 36', and the tongue 78 of lineal 36' may be snapped into the groove of opposing lineal 45'. This snapping action is produced by the resilience of the respective lineal arms 52' and 53' that permits the tongue lips 88 to pass transversely over the groove lips 90, and causes an interlocking engagement between the tongue lips and the groove lips that retains the tongues in the grooves and thereby secures the oppositely positioned lineals together to form the hollow mullion 28'. The advantage of this construction over that shown in FIG. 6 is that the opposing lineals are securely fastened together over their entire length instead of only where the clip oriented fasteners are located.

The mullion 28', as formed by securing together the pair of opposing lineals 36' and 45', may be mounted between the respective opposing surfaces 40 and 49 of anchored lineals 14 and 37 with the two fasteners 47 and 48 in the same manner as mullion 28 shown in FIGS. 2 and 8. After mullion 28' has been securely mounted in this manner, the edge of screen sheet 25 is attached to the mullion by being pushed into the groove 30 of lineal 45' by a spline strip 31, and the edge of screen sheet 39 is attached to the mullion by being pushed into the groove 30 of lineal 36' by another spline strip 31 as shown in FIG. 10.

Thus, two opposing lineals of either construction may be joined together to form a mullion by the universal fastener of the invention serving as an internal interlocking "clip" between the two. Alternatively, two opposing lineals of the modified construction may be joined together to form a mullion either by the lineal interlocking structure formed by a tongue along the distal edge portion of one arm and a groove along the distal edge portion of the other arm of each lineal, or by both the clip and arm interlocking structures, as illustrated in FIG. 10. If the interlocking clip is used alone, each of the joined lineals may be completely symmetrical because the tongue and groove along opposite arms may be omitted as shown in FIGS. 1 to 7C.

While specific structures for the lineals and fasteners and a specific method for their assembly into a frame system for mounting flexible sheets of material have been described and illustrated in detail, it will be apparent to those skilled in the art that many modifications and variations are possible without deviating from the broad scope of the present invention. For example, the channels forming the lineals and the solid pieces forming the fasteners may have other cross-sectional shapes, and the fasteners may be hollow instead of solid. In addition, the spline grooves, the tongues, the tongue grooves, the channel arms, and the notches, lips, bosses, ledges and other interlocking structures, may have a wide variety of shapes and sizes that provide the same functions. Thus, the specific embodiments described herein are for the purpose of illustrating the present invention, and persons skilled in the art will recognize variations thereof that fall within the scope of this invention, which is limited only by the claims appended hereto, and the equivalence of the features described therein.

What is claimed is:

1. A system for mounting flexible sheets of material to a framework, said system comprising:

(a) a lineal having a long dimension and being formed to have a U shaped cross section and with a groove formed therein parallel to said long dimension;

(b) a spline dimensioned to fit into said groove and to hold a flexible sheet of material therein; and (c) a fastener formed to have two securing orientations, an anchor orientation in which said fastener is securable to a framework so that said lineal covers said fastener completely and grips said fastener thereby securing said lineal to said framework, and a clip orientation in which said fastener is securable to a surface and two lineals are secured together about said fastener, each lineal of said two lineals covering half of said fastener and being held in place on said surface by said fastener.

2. The system of claim 1 wherein said fastener has at least one aligning groove capable of receiving an aligning wire.

3. The system of claim 1 wherein said lineals are made of plastic.

4. The system of claim 1 wherein said lineals are made of aluminum.

5. The system of claim 4 wherein said lineals are powder coated.

6. The system of claim 1 wherein said lineals are made of pulltruded fiberglass.

7. The system of claim 1 wherein said fasteners are made of plastic.

8. The system of claim 1 wherein said fasteners have a hole formed therein dimensioned to receive a screw.

9. The system of claim 1 further comprising:

screws for securing said fastener to said framework or said surface.

10. A system for closing a rectangular opening in a framework; said system comprising:

(a) flexible sheeting;

(b) lineals, each lineal of said lineals having a long dimension and being formed to have a U shaped cross section and with at least one spline groove formed therein parallel to said long dimension;

(c) splines dimensioned to fit into said at least one spline groove and to hold said flexible sheeting therein; and (d) plural fasteners, each fastener of said plural fasteners formed to have two securing orientations, an anchor orientation in which said each fastener is securable to a framework so that said lineals cover said each fastener completely and grip said each fastener thereby securing said lineals to said framework, and a clip orientation in which said each fastener is securable to a surface and two lineals of said lineals are securable together about said each fastener, each lineal of said two lineals covering half of said fastener and being held in place on said surface by said each fastener.

11. The system as recited in claim 10, wherein said each fastener has at least two holes formed therein for use in securing said each fastener to said framework.

12. The system as recited in claim 11, wherein said at least two holes is four holes.

13. The system as recited in claim 10, wherein said each fastener has at least one alignment groove for use in aligning said each fastener with another of said each fasterner.

14. The system as recited in claim 13, wherein said at least one alignment groove is two alignment grooves.

15. The system as recited in claim 10, wherein said at least one spline groove formed in said each lineal is two spline grooves.

16. The system as recited in claim 10, wherein said each lineal includes a base and opposing resilient arms, each arm of said opposing arms having distal edge portions with inwardly projecting ledges and depending L-shaped stops formed thereon, said inner edges of these ledges defining a transverse space for receiving said fasteners.

17. The system as recited in claim 10, wherein said each fastener includes a central column with a base surface at one end and an opposing radially projecting rim forming a crown, said crown having at least one pair of opposing notches formed therein to define at least two arcuate bosses.

18. The system as recited in claim 17, wherein said at least one pair of opposing notches is two pair so that said at least two arcuate bosses is four arcuate bosses.

19. A method for mounting flexible sheets to cover a framework, said method comprising the steps of;

(a) securing fasteners all around a framework;

(b) snapping lineals over said fasteners so that said lineals are anchored to said framework by said fasteners and substantially cover said fasteners, said lineals having spline grooves;

(c) fastening said fasteners to said lineals in opposing relationship;

(d) snapping two lineals together over said opposing fasteners to divide said opening;

(e) pressing a flexible sheet into said spline grooves of said lineals by forcing splines into said grooves over said flexible sheet.

20. The method of claim 19 wherein said fasteners have alignment grooves and wherein said method further comprises the step of running a line through said alignment grooves of said fasteners to align said fasteners before securing said fasteners to said framework.

* * * * *